US006830592B2

(12) United States Patent
Fuminori

(10) Patent No.: US 6,830,592 B2
(45) Date of Patent: Dec. 14, 2004

(54) BLEACHING METHOD OF NATURAL FIBERS WITHOUT DEWAXING

(75) Inventor: Kanke Fuminori, Yawatahama (JP)

(73) Assignee: Marusan Industrial Co., Ltd., Yawatahama (JP)

( * ) Notice: Subject to any disclaimer, the term of this patent is extended or adjusted under 35 U.S.C. 154(b) by 41 days.

(21) Appl. No.: 10/370,096

(22) Filed: Feb. 21, 2003

(65) Prior Publication Data

US 2003/0226209 A1 Dec. 11, 2003

(30) Foreign Application Priority Data

Feb. 22, 2002 (JP) ..... 2002-046725

(51) Int. Cl.[7] ..... D06L 3/02
(52) U.S. Cl. ..... 8/111; 8/107
(58) Field of Search ..... 8/107, 111

(56) References Cited

U.S. PATENT DOCUMENTS 5,575,947 A * 11/1996 Venturello et al. ..... 252/186.26
6,551,358 B2 * 4/2003 Miller et al. ..... 8/139
6,743,761 B2 * 6/2004 Wang ..... 510/276

* cited by examiner

*Primary Examiner*—Margaret Einsmann
(74) *Attorney, Agent, or Firm*—Bacon & Thomas

(57) ABSTRACT

The invention provides a bleaching method of natural fibers. By the invention, it is possible to bleach raw cotton fibers without dewaxing. The method of the invention is to bring the natural fibers on each of which wax adhere, into contact with water solution containing hydroxy percarboxilic acid for bleaching. The natural fibers may be raw cotton fibers. The hydroxy percarboxilic acid may be perlactic acid. The water solution may contain hydroxy carboxilic acid, hydrogen peroxide and alkali agent with hydroxy percarboxilic acid.

7 Claims, No Drawings

BLEACHING METHOD OF NATURAL FIBERS WITHOUT DEWAXING

TECHNICAL FIELD

The present invention relates to a bleaching method of natural fibers or raw flax fibers on each of which wax adhere. Especialy, the invention relates to the method for bleaching the natural fibers with the wax on. Furthermore, the invention relates to the natural fibers obtained with the bleaching method, and relates to nonwoven fabric consisting of the natural fibers obtained with the bleaching method.

In the present invention, the wax means natural oil and natural fat adhereing on the natural fiber.

BACKGROUND ART

Natural fibers such as raw cotton fibers which are not bleached, are used as fibers for consisting of the cotton spun yarn and fibers for consisting of nonwoven fabric. However, colors of the natural fibers are brown or light brown or etc. Therefore, the natural fibers may be not used for medical material and clothing material.

Because of the above problem, the natural fibers have been bleached. However, bleaching the natural fibers directly, it has been impossible to bleach uniformly. For example, dipping the raw cotton fibers in the water solution which contains sodium hypochlorite, sodium chlorite or hydrogen peroxide, it has been impossible to bleach uniformly. This reason is that the density of the fibers is not uniformly, and there are low density part and high density part in the mass of the raw cotton fibers. That is, in the high density part, it is impossible to remove the wax on the fiber and impossible to bleach sufficiently. Because the quantity of the water solution which permeat in the high density part is small. On the other hand, in the low density part, it is possible to remove the wax and bleach sufficiently. Because the quantity of the water solution which permeat in the low density part is large. Therefore, the mass of the raw cotton fibers may not be bleached uniformly.

Because of the above problem, to bleach the raw cotton fibers uniformly, the method for manufacturing absorbent cotton is adopted as the method for manufacturing of the raw cotton fibers. That is, the method is comprising of the scouring step and the bleaching step. The scouring step is comprising of removing the impurity as seeds, stalks and shells which exist in the raw cotton fibers by cleaning with alkali detergent, and removing the wax from the raw cotton fiber. The bleaching step after the scouring step is comprising of dipping the raw cotton fibers in the water solution for bleaching to be the prescribed whiteness. However, because the wax is removed from the bleached cotton fibers which are obtained by the above way, it is impossible to open the bleached cotton fibers by a opener as a carding machine. Therefore, after applying oil for opening by a spray method to the bleached cotton fibers, the fibers are opened by the opener, and the spun yarn or the nonwoven fabric is manufactured.

Because of the above problem, it is necessity to bleach the raw cotton fibers while the wax remains on the raw cotton fiber. It may be thinked to directly apply the raw cotton fibers to the bleaching step without the scouring step, but it is impossible to bleach uniformly as above said. Furthermore, in the case that is bleaching the raw cotton fibers by using a large quantity of the water solution for bleaching, it may be possible to bleach uniformly but the wax is removed by the large quantity of the water solution for bleaching.

SUMMARY OF THE INVENTION

The inventor has investigated the method of bleaching the raw cotton fibers while the wax remains on the raw cotton fiber. As the result, the inventor has discovered the specific bleaching agent by which the raw cotton fibers may be bleached while the wax remains. The specific bleaching agent is hydroxy percarboxilic acid, especially perlactic acid. The present invention has been completed on this discovery.

The present invention is a bleaching method of natural fibers without dewaxing comprising of bringing the natural fibers on each of which wax adhere, into contact with water solution containing hydroxy percarboxilic acid for bleaching.

Typically, the raw cotton fibers are used as the natural fibers. Moreover, flax fibers, silk fibers and wool fibers are used as the natural fibers. The wax adhere on the surface of the raw cotton fiber.

The wax is comprising of natural oil and natural fat. Vegetable oil or animal oil which is natural oil, adhere on the surface of the flax fiber, silk fiber or wool fiber. The raw cotton fibers may be from India, Australia, America, Egypt or China.

The water solution contains hydroxy percarboxilic acid. The hydroxy percarboxilic acid is having hydroxyl group [—OH] and percarboxyl group [—COOOM (M is basic group as hydrogen or alkali metal.)] in the molecular formula. Typically, the hydroxy percarboxilic acid is perlactic acid [$HOCH(CH_3)COOOH$]. Hydroxy percarboxilic acid content in the water solution is optional, but preferably is from 0.0005 wt % to 0.5 wt % on the stability of the hydroxy percarboxilic acid. The inventor is thinking that the hydroxy percarboxilic acid is having the ability of bleaching the raw cotton fiber without dewaxing. That is, it is possible to bleach the raw cotton fiber without dewaxing, in the only case using the hydroxy percarboxilic acid. As the above discribed, it is impossible to bleach the raw cotton fiber without dewaxing, in the case using sodium hypochlorite, sodium chlorite or hydrogen peroxide. Furthermore, it is impossible to bleach the raw cotton fiber because of existing the wax, in the case using percarboxilic acid as peracetic acid which is having percarboxyl group but is not hydroxyl group in the molecular formula.

It is preferable to contain hydroxy carboxilic acid, hydrogen peroxide and/or alkali agent with the hydroxy percarboxilic acid in the water solution. It is more preferable to contain hydroxy carboxilic acid and hydrogen peroxide together, because the hydroxy percarboxilic acid is producted by equilibrium reaction when the hydroxy percarboxilic acid has been used. The hydroxy carboxilic acid may be lactic acid, citric acid, tartaric acid or their mixture. The hydroxy carboxilic acid content in the water solution is optional, but preferably is from 0.01 wt % to 2.0 wt %. The hydrogen peroxide content in the water solution is optional, but preferably is from 0.1 wt % to 5.0 wt %. The alkali agent is used to remove the impurity in the raw cotton fibers. The alkali agent may be sodium hydroxide, potassium hydroxide, alkanolamine, ammonia or their mixture. The sodium hydroxide is preferable as the alkali agent. The alkali agent content in the water solution is optional, but preferably is from 0.1 wt % to 5.0 wt %. When the alkali agent content is more over 5.0 wt %, the wax may be removed.

It is preferable to contain stabilizer as sodium silicate or magnesium compound in the water solution. The stabilizer may be having the ability to maintain the bleaching function of the hydroxy percarboxilic acid, when the water solution is alkaline. The stabilizer content in the water solution is optional, but preferably is from 0.01 wt % to 4.0 wt %. Furthermore, it is preferable to contain surfactant in the water solution. Because the water solution is easy to permeat in the mass of the raw cotton fibers by the function of the surfactant. The surfactant content in the water solution is preferably from 0.1 wt % to 3.0 wt %. Furthermore, it may be preferable to contain chlete agent which grasp metal ion in the water solution.

The natural fibers as the raw cotton fibers are brought into contact with the water solution. For example, the raw cotton fibers may be dipped in the water solution. The water solution may be passed through the container in which the raw cotton fibers are stuffed. The amount used of the water solution is preferably from 100 wt. to 1000 wt. on the basis of the raw cotton fibers 100 wt. Accordingly, when using the method of dipping, (the raw cotton fibers):(the water solution) is preferable from 1:1 to 1:10 in bath rasio. The temperature of the water solution is optional, but preferably is from 30° C. to 80° C. The period of contacting the raw cotton fibers into the water solution is optional, but preferably is from 30 min. to 2 hr.

After bleaching by contacting the natural fibers as the raw cotton fibers into the water solution, the bleached natural fibers are washed with water or hot water. And the bleached natural fibers without dewaxing are obtained and they are sufficiently bleached with the wax on. It is possible to open the bleached natural fibers by the carding machine without applying the oil for opening. Therfore, by using the bleached natural fibers themselves in the invention, it is possible to manufacture the spun yarn or the nonwoven fabric. For example, fabrous web is obtained by opening the bleached natural fibers themselves by the carding machine. The fabrous web is treated by water jet needle or needle punch, and the nonwoven fabric is obtained. The nonwoven fabric is consisting only of the natural material, that is, the natural fiber and the natural wax. Therefore, the nonwoven fabric is useful on environment and sanitation.

The bleached natural fibers as especially the bleached cotton fibers may be applied to the medical use, the kitchen's use or the pack's use of foodstuff. For example, a puff for makeup is made of the bleached cotton fibers. When using the puff for makeup, water is applied to it. As the bleached cotton fibers have the wax on, the applied water is difficult to penetrate to the back of the puff. Therefore, the applied water remains on the surface of the puff and is applied on the face without hindrance. An eirpick is made of the bleached cotton fibers. As the bleached cotton fibers have the wax on, it is easy to remove eirwax. The surfacer of sanitary napkin or disposable diaper which is directly contact with human body, is made of the nonwoven fabric consisting of the bleached cotton fibers. As the bleached cotton fibers have the wax on, the surfacer consisting of the nonwoven fabric is difficult to absorb human fluid. Therefore, the surfacer remains in dry condition. Furthermore, a sheet for removing harshness is made of the nonwoven fabric consisting of the bleached cotton fibers, because the wax absorb the harshness. A wiping cloth is made of the nonwoven fabric consisting of the bleached cotton fibers, because the wax absorb the oil and etc. which is used in cooking and etc.

An example of the present invention is hereinafter described. The invention is not limited to this example. It is to be understood that the invention is based on the discovery that the hydroxy percarboxilic acid bleaches the raw cotton fibers while the wax remains.

EXAMPLE

The natural fibers and the water solution were prepared as following.

The Natural Fibers

The raw cotton fibers from America

The Water Solution

| | |
|---|---|
| Perlactic acid | 0.02 g |
| Lactic acid | 0.08 g |
| Hydrogen peroxide | 3.24 g |
| The mixture of citric acid and tartaric acld | 0.38 g |
| Sodium hydroxide | 4.13 g |
| Stabilizer(sodium silicate) | 0.50 g |
| Surfactant(anionic surfactant) | 3.00 g |
| Water | 988.68 g |

The raw cotton fibers from America were dipped in the water solution the temperature of which is 60° C., for one hour and 1:5 in bath rasio. And the bleached cotton fibers were washed by the hot water the temparature of which is 90° C., for twenty minutes. After washing, the bleached cotton fibers were neutralized by a water solution of acetic acid, and washed by water for thirty minutes, and dried. By the above discribed steps, the bleached cotton fibers with the wax were obtained.

About the obtained cotton fibers, the remaining percent of the wax were measured as following steps.

(i) The sample of 2 g was extracted from the obtained cotton fibers.

(ii) The sample was pushed into the test tube.

(iii) Ethnol of 20 cc was put into the test tube, and the wax on the sample was soluted in the ethnol by leaving for about two minutes.

(iv) The ethnol was withdrawn from the test tube, and the ethnol was put on the alminum tray the weight of which was Xg.

(v) After evaporating the ethnol, the alminum tray was weighed. As the result, the weight of the alminum tray was Yg.

(vi) The remaining percent of the wax was calucated by the formula which was $[(Y-X)/2]\times 100$.

About the cotton fibers which was obtained by the above example, the remaining percent of the wax was 0.52%. Accordingly, the wax had sufficiently remained on the bleached cotton fiber which was obtained by the above example.

Furthermore, about the obtained cotton fibers, the degree of the color saturation was measured on JIS Z 8722. As the result, L* was 88.2, and a* was −5, and b* was 4.2. Accordingly, the obtained cotton fibers was sufficiently bleached and had satisfied the whiteness of the absorbent cotton which was specified on the Pharmacopoeia of Japan.

What is claimed is:

1. A bleaching method of natural fibers without dewaxing comprising of bringing the natural fibers on each of which wax adhere, into contact with water solution containing hydroxy percarboxilic acid for bleaching.

2. The bleaching method of claim 1 wherein said natural fibers are raw cotton fibers.

3. The bleaching method of claim 1 wherein said hydroxy percarboxilic acid is perlactic acid.

4. The bleaching method of claim 1 wherein said water solution contains said hydroxy percarboxilic acid, hydroxy carboxilic acid, hydrogen peroxide and alkali agent.

5. The bleaching method of claim 4 wherein said hydroxy percarboxilic acid is perlactic acid, and said hydroxy carboxilic acid is selected from the group consisting of lactic acid, citric acid and tartaric acid, and said alkali agent is sodium hydroxide.

6. Natural fibers without dewaxing which are obtained with the bleaching method of claim 1.

7. Nonwoven fabric which is consisting of said natural fibers of claim 6.

* * * * *